US010422596B2

(12) United States Patent
Kramer

(10) Patent No.: US 10,422,596 B2
(45) Date of Patent: Sep. 24, 2019

(54) BOLT CARRIER GROUP FOR DIRECT GAS IMPINGEMENT SYSTEM

(71) Applicant: Kramer Cartridge & Carbine LLC, Las Vegas, NV (US)

(72) Inventor: Lawrence S. Kramer, Las Vegas, NV (US)

(73) Assignee: KRAMER CARTRIDGE & CARBINE LLC, Las Vegas, NV (US)

( * ) Notice: Subject to any disclaimer, the term of this patent is extended or adjusted under 35 U.S.C. 154(b) by 0 days.

(21) Appl. No.: 16/179,557

(22) Filed: Nov. 2, 2018

(65) Prior Publication Data

US 2019/0072345 A1 Mar. 7, 2019

Related U.S. Application Data

(63) Continuation-in-part of application No. 16/005,381, filed on Jun. 11, 2018.

(60) Provisional application No. 62/518,166, filed on Jun. 12, 2017.

(51) Int. Cl.

| | |
|---|---|
| ***F41A 5/24*** | (2006.01) |
| ***F41A 3/66*** | (2006.01) |
| ***F41A 3/16*** | (2006.01) |
| ***F41A 5/22*** | (2006.01) |

(52) U.S. Cl.

CPC *F41A 5/24* (2013.01); *F41A 3/16* (2013.01); *F41A 3/66* (2013.01); *F41A 5/22* (2013.01)

(58) Field of Classification Search

CPC ..... F41A 5/24; F41A 3/16; F41A 3/66; F41A 5/22

USPC ..... 89/193

See application file for complete search history.

(56) References Cited

U.S. PATENT DOCUMENTS

| | | | | |
|---|---|---|---|---|
| 3,592,101 A * | 7/1971 | Vartanian | F41A 5/26 | 89/193 |
| 4,244,273 A * | 1/1981 | Langendorfer, Jr. | F41A 5/28 | 89/193 |
| 4,246,830 A * | 1/1981 | Krieger | F41A 19/13 | 89/132 |
| 4,765,224 A * | 8/1988 | Morris | F41A 5/26 | 42/75.02 |
| 5,272,956 A * | 12/1993 | Hudson | F41A 5/28 | 42/72 |
| 5,351,598 A * | 10/1994 | Schuetz | F41A 5/18 | 42/25 |

(Continued)

*Primary Examiner* — Michelle Clement

(74) *Attorney, Agent, or Firm* — Patterson + Sheridan, LLP

(57) ABSTRACT

Bolt carrier groups (BCGs) for weapon systems are provided herein. The BCG includes a carrier assembly, a bolt assembly, and a gas chamber disposed therebetween. The carrier assembly contains a carrier body that includes a shoulder, a piston surface, and an inlet port. The shoulder is disposed within the carrier body and contains a channel and the piston surface is located on the shoulder at least partially encompassing the channel. The inlet port extends through the carrier body and is configured for receiving propellant gas into the carrier body. The bolt assembly is at least partially contained within the carrier assembly and includes a bolt head opposite of a bolt tail where the bolt tail is at least partially protruding into the channel in the shoulder. The gas chamber is disposed between the carrier body, the piston surface, the bolt tail, and two gas seals disposed on the bolt assembly.

20 Claims, 9 Drawing Sheets

(56) References Cited

U.S. PATENT DOCUMENTS 5,726,377 A * 3/1998 Harris ..... F41A 19/14 42/65
5,824,943 A * 10/1998 Guhring ..... F41A 5/26 89/192
5,911,173 A * 6/1999 Westrom ..... F41A 15/12 89/185
7,275,472 B1 * 10/2007 Finn ..... F41A 3/74 89/26
8,893,608 B2 * 11/2014 Kramer ..... F41A 5/26 89/193
9,435,593 B2 * 9/2016 McGinty ..... F41A 35/06
9,863,729 B2 * 1/2018 Blank ..... F41A 3/26
10,151,544 B1 * 12/2018 Sugg ..... F41A 5/26
2002/0073832 A1 * 6/2002 Vignaroli ..... F41A 5/18 89/191.01
2010/0186582 A1 * 7/2010 Juarez ..... F41A 5/28 89/191.01
2012/0180648 A1 * 7/2012 Sullivan ..... F16J 9/16 89/193
2013/0269510 A1 * 10/2013 Sullivan ..... F41A 5/28 89/193
2013/0284008 A1 * 10/2013 Pizano ..... F41A 5/26 89/193
2014/0060294 A1 * 3/2014 Brown ..... F41A 5/24 89/1.4
2014/0076144 A1 * 3/2014 Gomez ..... F41A 3/38 89/132
2014/0076151 A1 * 3/2014 Kramer ..... F41A 5/26 89/193
2014/0144314 A1 * 5/2014 Jensen ..... F41A 3/64 89/193
2014/0318361 A1 * 10/2014 Larue ..... F41A 5/24 89/193
2015/0184960 A1 * 7/2015 Monveldt ..... F41A 5/26 89/193
2015/0226502 A1 * 8/2015 Beaty ..... F41A 5/28 89/193
2015/0241149 A1 * 8/2015 McMillen, IV ..... F41A 5/28 89/193
2015/0260467 A1 * 9/2015 Blank ..... F41A 3/30 42/25
2016/0047612 A1 * 2/2016 Sullivan ..... F16J 9/16 89/191.01
2016/0076834 A1 * 3/2016 McGinty ..... F41A 35/06 89/194
2016/0178308 A1 * 6/2016 Daniel ..... F41A 35/00 89/193
2017/0153075 A1 * 6/2017 DeSomma ..... F41A 3/66
2017/0234634 A1 * 8/2017 Hirt ..... F41A 5/18 89/193
2018/0172373 A1 * 6/2018 Maranli ..... F41A 3/26

* cited by examiner

BOLT CARRIER GROUP FOR DIRECT GAS IMPINGEMENT SYSTEM

CROSS-REFERENCE TO RELATED APPLICATIONS

This application is a continuation-in-part of U.S. application Ser. No. 16/005,381, filed Jun. 11, 2018, which claims benefit of U.S. Appl. No. 62/518,166, filed Jun. 12, 2017, which are herein incorporated by reference in their entirety.

BACKGROUND

Field

Embodiments described herein generally relate to gas operating systems for weapon systems, and more specifically to bolt carrier groups (BCGs) and related direct gas impingement system used in semi-automatic and/or full-automatic weapon systems, such as the AR15, M16, and M4 weapon systems.

Description of the Related Art

The AR15, M16, and M4 weapon systems were originally designed to operate with a traditional direct gas impingement (DGI) system. The DGI system uses gases generated from the fired cartridge to operate the weapons action. Gases from the fired cartridge are tapped from a gas port in the barrel and directed back through a "gas tube" into the bolt carrier key and bolt carrier, pressurizing a small chamber between the rear of the bolt and the bolt carrier. Expanding gases drive the bolt carrier to the rear, unlocking the bolt from a barrel extension allowing the bolt and carrier to move to the rear and cycle the action of the weapon.

For the weapon to operate correctly and reliably, the action components of the AR15, M16, and M4 weapon systems should be kept well lubricated, specifically the bolt and bolt carrier components, to avoid malfunctions. Due to the way traditional DGI systems operate, a DGI system delivers heat and carbon from each fired cartridge back into the action of the weapon, most notability the bolt and bolt carrier and the inside of the upper receiver. The heat builds up quickly when the rifle is quickly fired fast in full-automatic mode or semi-automatic mode. The heat and carbon dries out the lubrication used on the action to keep the action operating, which requires adding more lubrication to maintain the weapons reliability. This process leads to the action of the weapon becoming "gummed up" or stuck and can lead to malfunctions. This repeated adding of lubrication to keep the weapon operational also attracts dust and dirt from desert type environments which can also lead to more frequent malfunctions. The rapid heat buildup from this design also has a negative impact on the weapons parts, contributing to early parts failure.

The traditional DGI system used in the AR15, M16, and M4 weapon systems was effective but very inefficient, and is a "leaky" and wasteful design, requiring much more of the propellant gasses to operate the weapon than what are actually needed. The traditional DGI system's "open design" contributes to its overheating and fouling of the weapons action. The area of the system where this is most apparent is the rear of the gas tube and the carrier key located on top of the bolt carrier. The carrier key slides over the rear of the gas tube and rests there until the weapon is fired. When the weapon is fired the carrier moves to the rear as the system is pressurized. As the bolt carrier moves to the rear the carrier key retracts from the gas tube and the carrier continues moving rearward approximately three inches to cycle the action. Pressurized gases from the fired cartridge continue to flow out of the gas tube even after the carrier key has separated from the rear of the gas tube, depositing hot dirty carbon laden gasses into the upper receiver of the weapon until the bolt carrier is again moved forward by the operating spring and the carrier key covers the exposed rear of the gas tube and the action closes. Pressurized gases from the fired cartridge continue to flow out the rear of the gas tube the entire time it is not covered by the carrier key.

The gas chamber of the traditional DGI system is made up of the rear of the bolt and back inside of the bolt carrier. The front of this chamber that is the rear of the bolt has three gas rings on a journal that forms a tight seal and contains the gases, the rear of the gas chamber formed by the bolt carrier has an open channel that the back or tail of the bolt sits in, there is a large gap in this location between the tail of the bolt and the bolt carrier channel, it is not sealed with gas rings like the front of the chamber. This open space allows the pressurized gases to flow freely out the back of the bolt carrier. This "loose fit open design" allows propellant gases to escape out of the rear of the carrier depositing hot, dirty propellant gasses into the upper receiver, contributing to fouling of the action and weapon malfunctions.

Another drawback to the DGI system for the AR15 type weapons, and more notably the military's current individual combat weapon, the M4 carbine, is the fact that the weapon cycles too fast due to its short carbine length gas system, and the cyclic rate of fire when fired on full automatic is excessively high because the weapon is "over gassed" or receives more gas volume than is necessary to ensure some reliability when the weapon becomes dirty. Several factors that contribute to the speed at which the weapon operates or cycles include the size of the gas port in the barrel, the gas port location (distance from the chamber), operating spring strength, and the weight of the buffer assembly. To keep the weapon functional and reliable, these different components must be balanced to operate with each other.

There have been many attempts to control the speed of the bolt carrier in the DGI system, most common of which attempt to control the amount of gas entering the system, such as adjustable gas keys and gas blocks with screws that allow adjustments of the flow of propellant gas into the system. Small assemblies like gas keys and gas blocks with screw type adjustments can become gummed up with carbon and/or unburned propellant making the devices difficult to adjust gas flow. Other ways to control the speed of the bolt carrier is with the use of hydraulic buffers and combination hydraulic and spring buffers, as well as, heavier buffer assemblies and buffer springs with greater k-value or additional coils over traditional mil-spec buffer springs.

Civilian competition shooters often adjust their individual weapons to operate reliably with specific ammunition, delivering just enough volume and pressure to cycle the weapon while at the same time minimizing recoil so they can remain on target for the next shot. These shooters are also limited to the existing options mentioned above. These adjustment options are more limited to law enforcement and military users who must use the issued weapon, usually a standardized weapon system that cannot be easily modified or may not be modified by the shooter or operator to maintain reliability as the "adjustable" component is not reliable when exposed to heavy or prolonged use in military or law enforcement situations. The use of a sound suppressor on such weapon also produces back-pressure that may negatively affect the cycling of the weapon unless one or more of the other variables in the weapon and ammunition systems are adjusted for the back-pressure.

Therefore, there is a need for a BCG that has better control of the cycle speed in a direct gas impingement system so to have more consistent cycling than a traditional BCG used in weapon systems having direct gas impingement.

SUMMARY

Implementations described herein generally relate to gas operating systems for weapon systems, and more specifically to a bolt carrier group (BCG) and related direct gas impingement system used in semi-automatic and/or full-automatic weapon systems, such as the AR15, M16, and M4 weapon systems. In one or more embodiments, a BCG for a weapon system can include a carrier assembly, a bolt assembly, and a gas chamber disposed therebetween. The carrier assembly contains a carrier body that includes a shoulder, a piston surface, one or more inlet ports, and one or more exhaust ports. The shoulder is disposed within the carrier body and contains a channel therethrough and the piston surface is located on the shoulder at least partially encompassing the channel in the shoulder. The inlet port extends through the carrier body and is configured for receiving propellant gas into the carrier body. The exhaust port extends through the carrier body and is configured for removing the propellant gas from the carrier body. The bolt assembly is at least partially contained within the carrier assembly and includes a bolt head opposite of a bolt tail where the bolt tail is at least partially protruding into the channel in the shoulder. The gas chamber is disposed between the carrier body, the piston surface, the bolt tail, and two gas seals disposed on the bolt assembly.

In other embodiments, the bolt carrier group for a weapon system can include a carrier assembly, a bolt assembly, and a gas chamber disposed therebetween. The carrier assembly contains a carrier body that includes a shoulder, a piston surface, and one or more inlet ports. The shoulder is disposed within the carrier body and contains a channel therethrough. The piston surface is located on the shoulder at least partially encompassing the channel in the shoulder. The inlet port extends through the carrier body and configured for receiving propellant gases into the carrier body. The bolt assembly is at least partially contained within the carrier assembly and contains a bolt head opposite of a bolt tail. The bolt tail is at least partially protruding into the channel in the shoulder. The gas chamber is disposed between the carrier body, the piston surface, the bolt tail, and two gas seals disposed on the bolt assembly. In some examples, the two gas seals include a forward gas seal and a rear gas seal, the forward gas seal is disposed between the rear gas seal and the bolt head and the forward gas seal contains a forward chamber surface area. The forward chamber surface area is greater than a piston surface area of the piston surface, such that the piston surface area is about 98% or less of the forward chamber surface area.

In some embodiments, an upper receiver assembly for a weapon system can include an upper receiver containing a barrel, a gas block fluidly coupled to the barrel, and a BCG fluidly coupled to the gas block, where the BCG is described and discussed herein.

BRIEF DESCRIPTION OF THE DRAWINGS

So that the manner in which the above recited features of the disclosure can be understood in detail, a more particular description of the disclosure, briefly summarized above, may be had by reference to implementations, some of which are illustrated in the appended drawings. It is to be noted, however, that the appended drawings illustrate only typical implementations of this disclosure and are therefore not to be considered limiting of scope, for the disclosure may admit to other equally effective implementations.

Figure 1:
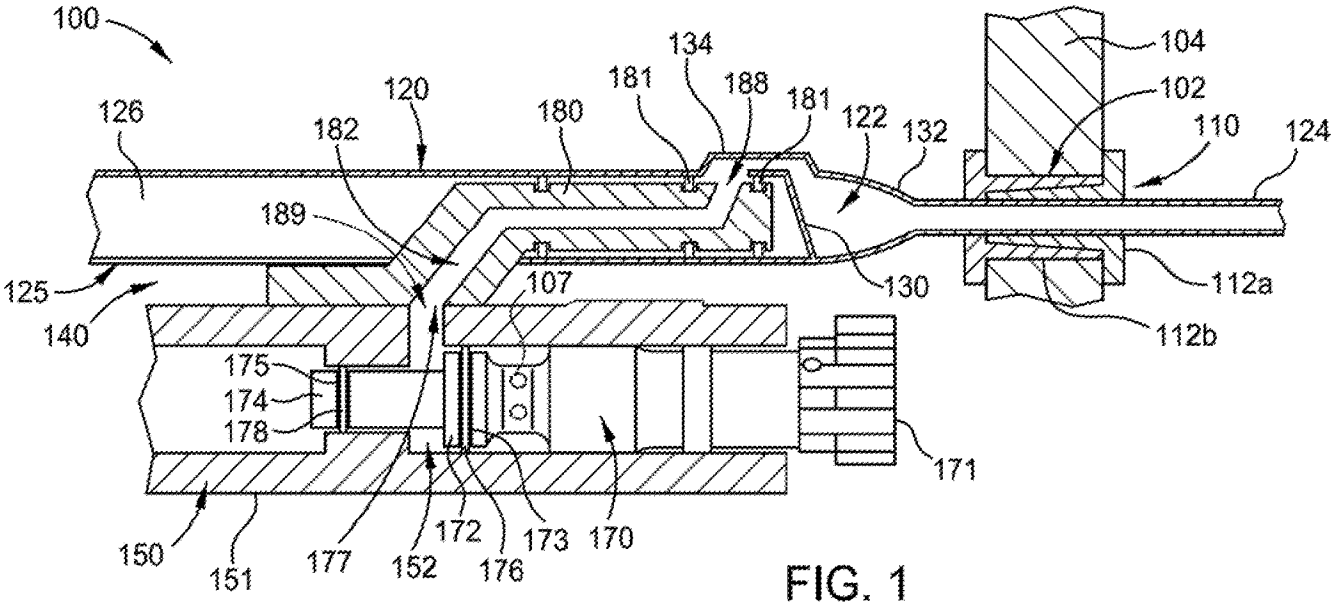
FIG. 1 depicts a partial schematic, cross-sectional view of a gas operating system for weapon systems, according to one or more embodiments described herein.

To facilitate understanding, identical reference numerals have been used, where possible, to designate identical elements that are common to the Figures. It is contemplated that elements and features of one implementation may be beneficially incorporated in other implementations without further recitation.

DETAILED DESCRIPTION

Implementations described herein generally relate to gas operating systems for weapon systems, and more specifically to direct gas impingement systems and bolt carrier groups (BCGs) used in automatic and/or semi-automatic weapon systems, such as the AR15, M16, and M4 weapon systems.

In one or more embodiments, a BCG for a weapon system can include a carrier assembly, a bolt assembly, and a gas chamber disposed therebetween. The carrier assembly contains a carrier body that includes a shoulder, a piston surface, one or more inlet ports, and one or more exhaust ports. The shoulder is disposed within the carrier body and contains a channel therethrough and the piston surface is located on the shoulder at least partially encompassing the channel in the shoulder. The inlet port extends through the carrier body and is configured for receiving propellant gas into the carrier body. The exhaust port extends through the carrier body and is configured for removing the propellant gas from the carrier body. The bolt assembly is at least partially contained within the carrier assembly and includes a bolt head opposite of a bolt tail where the bolt tail is at least partially protruding into the channel in the shoulder. The gas chamber is disposed between the carrier body, the piston surface, the bolt tail, and two gas seals disposed on the bolt assembly.

Figure 2:
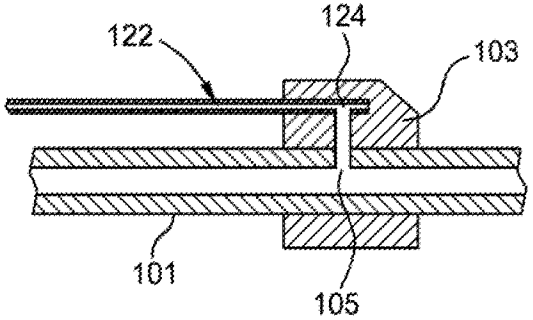
FIG. 2 depicts a schematic, cross-sectional view of another portion of the gas operating system shown in FIG. 1, according to one or more embodiments described herein.

FIG. 1 depicts a partial schematic, cross-sectional view of a gas operating system 100 for a firearm or other weapon system, according to one or more embodiments described herein. The gas operating system 100 is a direct gas impingement system and includes a gas channel carrier rail 120 and a bolt carrier group (BCG) 140. The gas channel carrier rail 120 contains a main gas channel 122 disposed between an inlet end 124 an outlet end 126. The outlet end 126 is flared or otherwise expanded to have a segment 132 that has a larger diameter than the inlet end 124. The outlet end 126 of the gas channel carrier rail 120 can also include an extended portion 134 on the upper surface of the gas channel carrier rail 120. The gas channel carrier rail 120, including the inlet end 124, the outlet end 126, the segment 132, and the extended portion 134 can be a monolithic piece, as depicted in FIGS. 1 and 2. The gas channel carrier rail 120 can be made of or contain one or more metals, such as steel, stainless steel, titanium, or alloys thereof.

The gas channel carrier rail 120 extends through an adjustable tensioner 110 that is attached to and passes through an opening 102 passing through a wall of the upper receiver 104 of the firearm, as depicted in FIG. 1. The adjustable tensioner 110 supports and provides passage of the gas channel carrier rail 120 through the opening 102 of the upper receiver 104. The adjustable tensioner 110 stabilizes the gas channel carrier rail 120 to ensure precise alignment within the upper receiver during cycling of the weapon. The adjustable tensioner 110 can be tensioned or tightened around the gas channel carrier rail 120, allowing for a more rigid configuration to increase the accuracy of the weapon. The adjustable tensioner 110 can be or include a collet, a grommet, a chuck, a tensioning collar, or other type of device for supporting and providing passage of the gas channel carrier rail 120 through the opening 102.

In one or more embodiments, the adjustable tensioner 110 is a two-piece member which includes interlocking components 112*a*, 112*b*, which are installed from opposite sides of the wall of the upper receiver 104 so to engage one another. In such an embodiment, each of the two pieces includes tapered surfaces which engage one another to form an interference fit. Each of the two pieces include a base portion for contacting outer (and opposite) surfaces of the upper receiver front wall. In one example, each of the two components 112*a* and 112*b* of the adjustable tensioner 110 are positioned concentrically with respect to one another. In some examples, the adjustable tensioner 110 is a grommet having two or more segments or portions, such as components 112*a* and 112*b*. As shown in FIG. 1, the component 112*b* of a grommet is screwed or otherwise coupled to the opening 102 of the upper receiver 104 and the component 112*a* of the grommet is disposed into the component 112*b*.

The inlet end 124 of the gas channel carrier rail 120 is configured to couple to a gas block 103 disposed on a barrel 101 of the weapon system, as depicted in FIG. 2. A passageway 105 is disposed between and in fluid communication of the barrel 101 and the main gas channel 122 at the inlet end 124. In one or more embodiments, the inlet end 124 of the gas channel carrier rail 120 includes a gas tube portion between the gas block 103 and the adjustable tensioner 110 that is straight or significantly straight and parallel or significant parallel to the barrel 101. In other embodiments, the inlet end 124 of the gas channel carrier rail 120 includes a gas tube portion between the gas block 103 and the adjustable tensioner 110 that has one or more bends or curves.

The gas block 103 can be any gas block that meets or exceeds U.S. military specifications for the M16 or M4 weapon systems or any gas block used in the AR15 weapon system. The gas block 103 attached to the barrel 101 that directs the expanding gases from the gas port 105 in the barrel 101 into the inlet end 124 of the gas channel carrier rail 120. The gas channel carrier rail 120 may attach to the gas block 103 with a pin or screw. In some examples, the gas block 103 can be a standard, non-adjustable gas block. In other examples, the gas block 103 can be an adjustable or tunable gas block. The gas block 103 may be any height or profile (e.g., low or high profile gas blocks) to accommodate the gas channel carrier rail 120 with straight line profile or a bent or curved profile.

The gas channel carrier rail 120 also contains a slot 125 (depicted in FIG. 4B and further discussed below) formed in the outlet end 126. The slot 125 extends along the gas channel carrier rail 120 in the same direction as the main gas channel 122. The gas channel carrier guide 180 extends through the slot 125 and is at least partially disposed into the gas channel carrier rail 120, as shown in FIG. 1.

The BCG 140 contains a carrier assembly 150, a bolt assembly 170, and a gas channel carrier guide 180. The bolt assembly 170 is at least partially contained within the carrier assembly 150. The bolt assembly 170 and the carrier assembly 150 are axial to one another. A bolt head 171 of the bolt assembly 170 extends from the carrier assembly 150.

The gas channel carrier guide 180 is disposed on a carrier body 151 of the carrier assembly 150. In one or more embodiments, the gas channel carrier guide 180 and the carrier body 151 are monolithic, as such, are formed or otherwise produced as a single unit having a one piece design. In other embodiments, the gas channel carrier guide 180 and the carrier body 151 are separate parts that are fastened or combined together. For example, one, two, three, or more fasteners can be used to couple the gas channel carrier guide 180 and the carrier body 151 together. In one example, the gas channel carrier guide 180 and the carrier body 151 are coupled together with two bolts that pass through the gas channel carrier guide 180 and into threaded holes in the carrier body 151 and are each staked at the gas channel carrier guide 180. In other examples, the gas channel carrier guide 180 and the carrier body 151 are welded together. Each of the gas channel carrier guide 180 and the carrier body 151 can be made of or contain one or more metals, such as steel, stainless steel, titanium, or alloys thereof.

The gas channel carrier guide 180 contains a secondary gas channel 182 passing therethrough. The secondary gas channel 182 is disposed between and in fluid communication with the main gas channel 122 and an interior (e.g., gas chamber 152) of the BCG 140. The gas channel carrier guide 180 contains a lower segment 184 and an upper segment 186. The lower segment 184 is coupled to the carrier assembly 150. The upper segment 186 extends through the slot 125 and is at least partially disposed into the gas channel carrier rail 120. The gas channel carrier guide 180 contains an inlet port 188 and an outlet port 189. The inlet port 188 is in fluid communication with and coupled to the main gas channel 122 and the outlet port 189 is in fluid communication with and coupled to an inlet port 177 formed through the carrier body 151 of the BCG 140. The secondary gas channel 182 extends from the inlet port 188 to the outlet port 189 and to the interior of the BCG 140, such as into the gas chamber 152, via the inlet port 177. In one or more embodiments, the gas channel carrier guide 180 can include a gas tube or guide that is hollow or has a passageway in the center with the secondary gas channel 182 that passes from the top center at the inlet port 188, through the neck of the guide, out of the bottom at the outlet port 189, and into the inlet port 177 on the carrier body 151 and into the gas chamber 152.

Figure 4A:
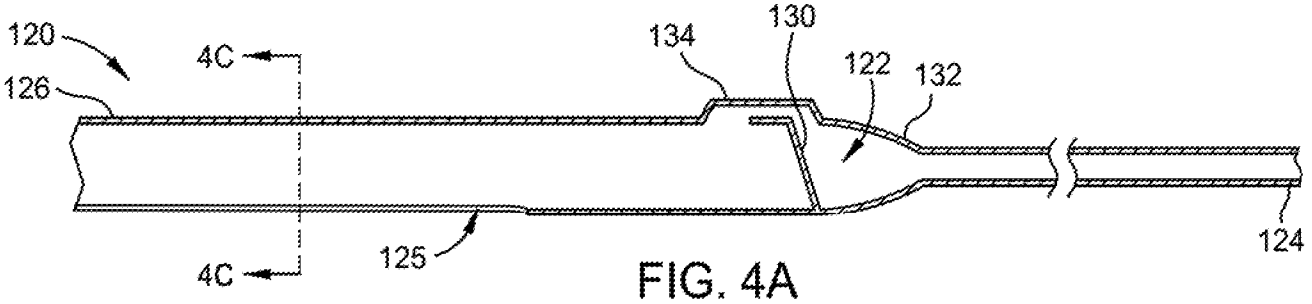
FIGS. 4A-4C depict schematic views of a gas channel carrier rail, according to one or more embodiments described herein.

The outlet end 126 of the gas channel carrier rail 120 contains one or more baffles 130 within the main gas channel 122, as depicted in FIGS. 1 and 4A. The baffles 130 can be within the flared or expanded segment 132 and/or the extended portion 134 of the outlet end 126. The baffle 130 and the flared or expanded segment 132 and/or the extended portion 134 helps direct gas flow of the propellant gas from the main gas channel 122 to the inlet port 188.

Figure 3B:
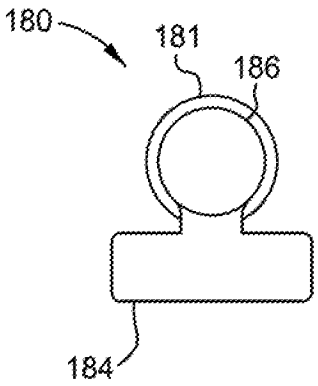
FIGS. 3A and 3B depict schematic views of a gas channel carrier guide, according to one or more embodiments described herein.
Figure 3A:
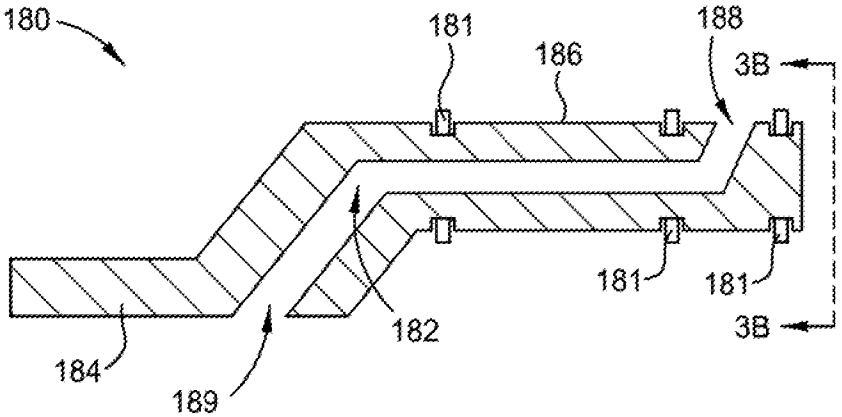

FIGS. 3A and 3B depict schematic views of the gas channel carrier guide 180, according to one or more embodiments described herein. FIG. 3A depicts a cross-sectional view and FIG. 3B depicts a front view of the gas channel carrier guide 180. The gas channel carrier guide 180 contains two, three, or more gas seals 181 disposed on an outer surface of the gas channel carrier guide 180. The gas seals 181 can be disposed in a groove or recess formed in the outer surface of the gas channel carrier guide 180, as shown in FIGS. 1 and 3A. The gas seals 181 are disposed between and in contact with the gas channel carrier guide 180 and the gas channel carrier rail 120. The gas channel carrier guide 180 contains the inlet port 188 in fluid communication with the main gas channel 122. The inlet port 188 is disposed between the two gas seals 181. The inlet port 188 is disposed on an upper surface of the gas channel carrier guide 180. In one or more embodiments, the gas channel carrier guide 180 provides a "sealed" channel that initially prevents the pressurized propellant gas from the fired cartridge from exiting the gas operating system 100. The gas channel carrier guide 180 and two gas seals 181 separated by the inlet port 188 form a fluid tight seal that directs exhausted propellant gas into the secondary gas channel 182.

The gas chamber 152 is formed or otherwise disposed within the interior of the BCG 140. The gas chamber 152 is in fluid communication with the main gas channel 122 via the secondary gas channel 182 disposed in the gas channel carrier guide 180. The gas chamber 152 is formed between the carrier assembly 150, the bolt assembly 170, and two or more gas seals 176, 178 therebetween. The two gas seals 176, 178 can include a first gas seal 176 and a second gas seal 178. The first gas seal 176 is contained on a journal or gas collar 172 disposed on the bolt assembly 170. The gas collar 172 can include one or more recesses or grooves 173 for containing one or more gas seals 176. The bolt assembly 170 has a bolt tail 174 that can include one or more recesses or grooves 175 for containing one or more gas seals 178. Alternatively, the boat tail 174 on the bolt assembly 170 does not have a recess or groove and therefore the second gas seal 178 can be contained directly on the surface of the bolt tail 174. Each of the gas seals 176, 178 can independently be or include 1, 2, 3, 4, or more rings, seals, gaskets, O-rings, or other devices used for gas sealing between two or more surfaces. In some examples, each of the gas seals 176, 178 can independently be metallic gas rings that meet or exceed U.S. military specifications for the M16 or M4 weapon systems. In one or more examples, the first gas seal 176 contains three metallic gas rings and the second gas seal 178 contains three metallic gas rings. In one or more embodiments, the bolt assembly 170 can be a bolt assembly that meets or exceeds U.S. military specifications for the M16 or M4 weapon systems, but has been modified by adding the second gas seal 178 on the bolt tail 174 and/or optionally modifying forming the recess or groove 175 on the bolt tail 174.

Figure 5:
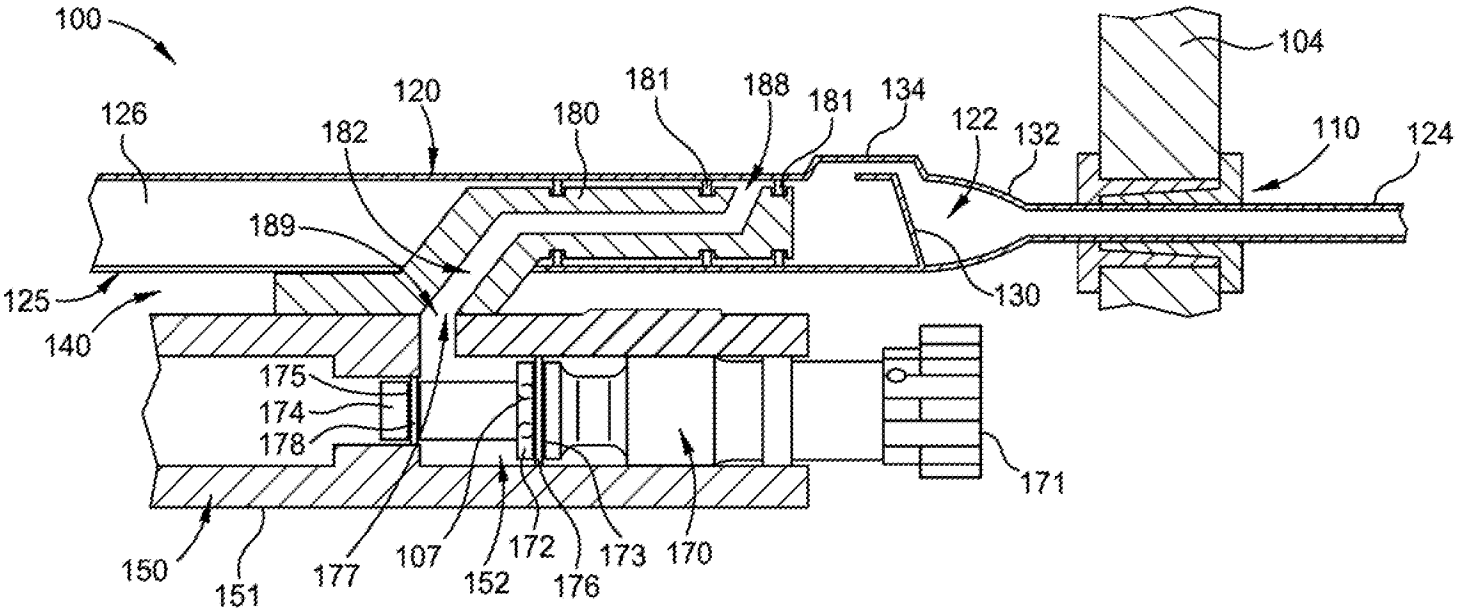
FIG. 5 depicts a schematic, cross-sectional view of the gas operating system shown in FIG. 1, where the system is pressurized with propellant gas and the carrier group has started to move towards the rear of the weapon, according to one or more embodiments described herein.

In FIG. 1, the bolt assembly 170 is depicted in a contracted or non-extended position relative to the carrier assembly 150. When in a weapon system, the bolt assembly 170 is all the way forward and the bolt head 171 is closed and locked into the barrel extension (not shown). The secondary gas channel 182 in the gas channel carrier guide 180 is aligned with the inlet port 188 in the gas channel carrier rail 120. In FIG. 5, the bolt assembly 170 is in a non-extracted or extended position relative to the carrier assembly 150. One, two, three, or more exhaust ports 107 (two exhaust ports are drawn in phantom in FIGS. 1 and 5) extend through the carrier body 151 to fluidly connect the gas chamber 152 to outside of the BCG 140 once the bolt assembly 170 is in the extended position (e.g., during cycling of the firearm) relative to the carrier assembly 150. The exhaust ports 107 are further described and discussed below. In other embodiments, the carrier body 151 can be a carrier body that meets or exceeds U.S. military specifications for the M16 or M4 weapon systems, but has been modified by increasing the diameter of the inner volume to provide clearance for the second gas seal 178 on the bolt tail 174 when the bolt assembly 170 is contained therein.

Although not shown in the Figures or described in the written description, the BCG 140 includes all other parts and components contained in a bolt carrier group that meets or exceeds U.S. military specifications for the M16 or M4 weapon systems. For example, exemplary parts or components used on or in the BCG 140 can be or include, but is not limited to, a firing pin, a firing pin retaining pin, a cam pin, an extractor, an ejector, all pins and springs used with the extractor and the ejector, and/or any combination thereof. In one or more embodiments, each of the gas channel carrier rail 120, the gas channel carrier guide 180, the carrier body 151, the bolt assembly 170, or any parts or portions thereof can independently have a coating or no coating. The coating can be or include an anodizing coating, a Parkerized coating, a phosphate coating (e.g., manganese phosphate), a nitride coating, a boride coating, a nickel coating (e.g., nickel boride or nickel nitride), a chromium coating, alloys thereof, or any combination thereof.

Figure 4B:
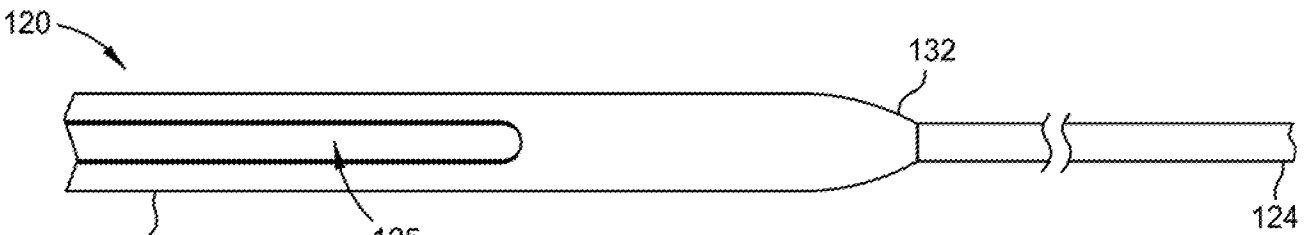
Figure 4C:
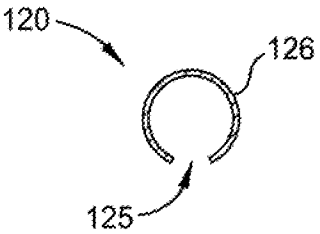

FIGS. 4A-4C depict schematic views of the gas channel carrier rail 120, according to one or more embodiments described herein. FIG. 4A depicts a cross-section view and FIG. 4B depicts a bottom view of the gas channel carrier rail 120. FIG. 4C is cross-sectional view of the outlet end 126 of the gas channel carrier rail 120. The inlet end 124 of the gas channel carrier rail 120 directs propellant gas from the gas block 103 back into the action of the weapon. After the propellant gas passes into the upper receiver 104, the rear portion or the outlet end 126 of the gas channel carrier rail 120 increases in diameter to a size which accommodates the gas channel carrier guide 180 therein. With the gas channel carrier guide 180 positioned in the gas channel carrier rail 120, the gas channel carrier rail 120 functions as a "guide" or track for the gas channel carrier guide 180 as the gas channel carrier guide 180 moves back and forth during operation within the gas channel carrier rail 120. Additionally, the gas channel carrier rail 120 also provides the main gas channel 122 for passage of the propellant gas to the secondary gas channel 182, and ultimately, to within the gas chamber 152, to facilitate operation of the weapons action.

A portion of the outlet end 126 of the gas channel carrier rail 120 has the slot 125, that can have an open "C" shape (FIGS. 4B and 4C), to accommodate insertion of the gas channel carrier guide 180 when inserting the BCG 140 into the action of the weapon. The slot 125 in the gas channel carrier rail 120 allows the neck of the gas channel carrier guide 180 to pass through when the weapon cycles, moving back and forth during cycling of the weapon.

FIG. 5 depicts a schematic, cross-sectional view of the gas operating system 100 that is pressurized with propellant gas and the BCG 140 has moved towards the rear of the weapon, according to one or more embodiments described herein. Also, relative to the gas operating system 100 depicted in FIG. 1, the secondary gas channel 182 in the gas channel carrier guide 180 has moved out of alignment with the main gas channel 122 (thereby preventing propellant gas flow into the secondary gas channel 182 of the gas channel carrier guide 180), as shown in FIG. 5. The bolt head 171 is also unlocked from the barrel extension (not shown). As the carrier assembly 150 and the gas channel carrier guide 180 move rearward, the front gas ring 181 on the gas channel carrier guide 180 keeps the propellant gases contained in the system 100 by moving the inlet port 188 out of fluid communication with the main gas channel 122 and isolated from the expanded segment 132 and/or the extended portion 134.

At this time, the bullet has exited the barrel 101 (FIG. 2) as the carrier assembly 150 continues rearward and the system pressure begins to drop. Additionally, the bolt assembly 170 has moved relatively forward in the carrier assembly 150 and opened the exhaust ports 107 in the right side of the carrier assembly 150 and the propellant gases are discharged through the exhaust ports 107. After the bullet has exited the muzzle and the pressure in the system drops, the exhaust ports 107 open and the pressurized gases are being vented out of the action. The pressurized gases are vented out of the action through the right side of the carrier assembly 150 before the front of the gas channel carrier guide 180 passes the slot 125 in the bottom of the gas channel carrier rail 120 when stroking rearward, thus keeping the gases contained in the system 100. At this point only residual unpressurized gases are present in the system 100, minimizing any gases from entering the other parts of the action. The BCG 140 is then forced back forward by the operating of buffer spring until the action is closed and the bolt head 171 is locked into the barrel extension and the weapon is ready to be fired again.

Figure 6A:
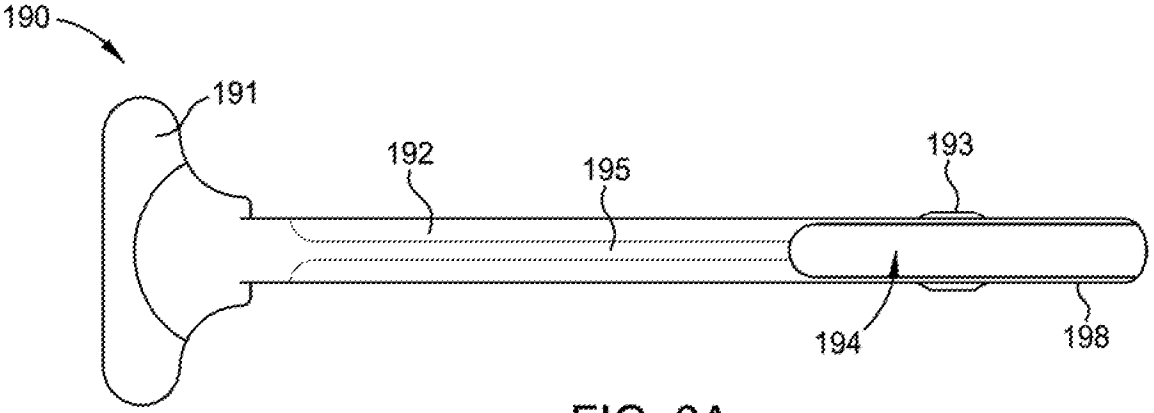
FIGS. 6A-6C depict schematic views of a charging handle, according to one or more embodiments described herein.
Figure 6B:
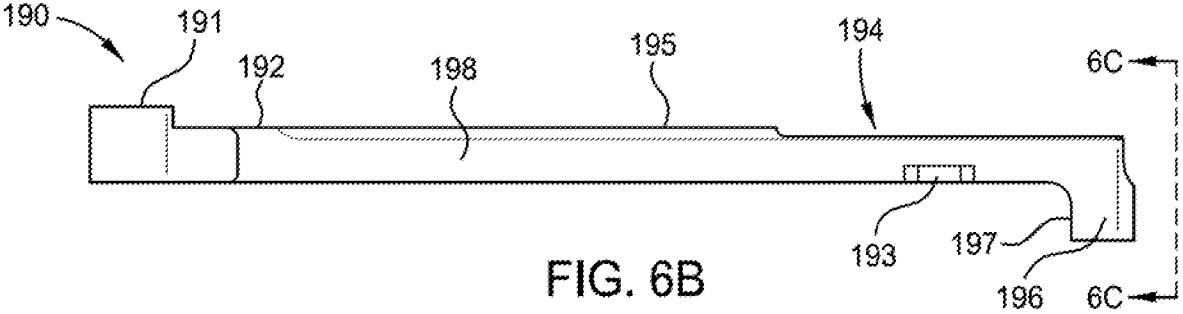
Figure 6C:
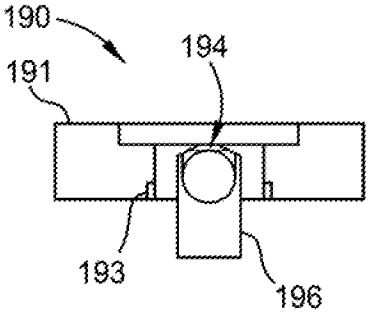

FIGS. 6A-6C depict schematic views of a charging handle 190, according to one or more embodiments described herein. FIG. 6A is a top view, FIG. 6B is a side view, and FIG. 6C is a front view of the charging handle 190. The charging handle 190 includes a handle portion 191 and an elongated lateral member 192. The handle portion 191 can include a locking or latching mechanism (not shown) for latching onto an outside surface of the firearm upper receiver when the charging handle 190 is forwardly inserted into the upper receiver. For example, the charging handle 190 can have a charging handle latch that meet or exceed U.S. military specifications for the M16 or M4 weapon systems. The lateral member 192 of the charging handle 190 has an upper surface 195, alignment tabs 193 protruding from the sides, a slot 194 formed therein, and an engagement portion 196. The alignment tabs 193 are used to align the charging handle 190 when installing the charging handle 190 into the upper receiver. The slot 194 is formed or otherwise defined between the upper surface 195, the sides 198, and the engagement portion 196. The slot 194 accommodates the gas channel carrier rail 120, especially, the outlet end 126 of the gas channel carrier rail 120, when inserting or removing the charging handle 190 during assembling and disassembling the weapon system.

Figure 7:
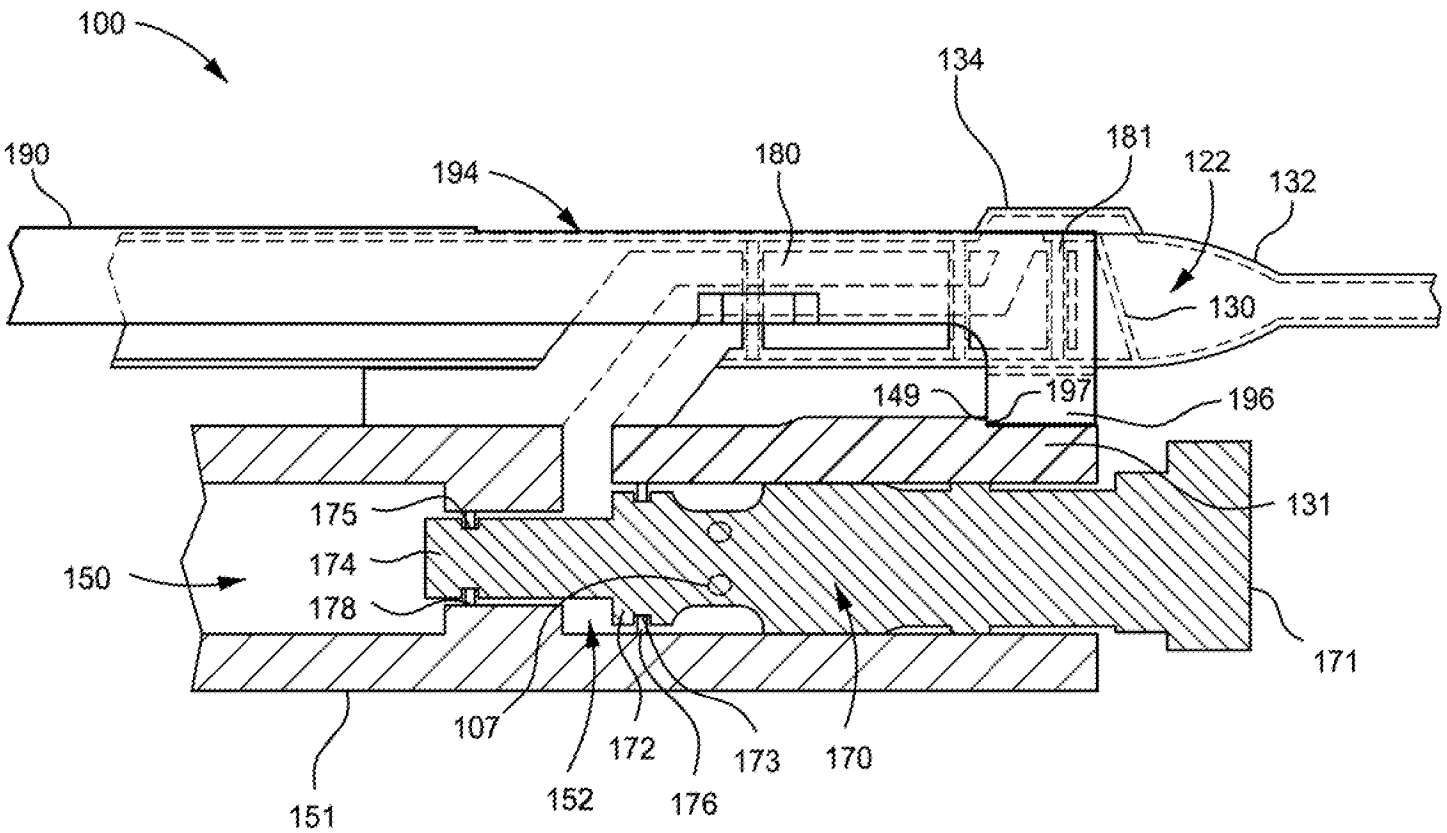
FIG. 7 depicts a schematic, cross-sectional view of the gas operating system shown in FIG. 1 containing a charging handle, according to one or more embodiments described herein.

FIG. 7 depicts a schematic, cross-sectional view of the charging handle 190 disposed in the gas operating system 100, according to one or more embodiments described herein. The charging handle 190 is disposed around at least a portion of the outlet end 126 of the gas channel carrier rail 120. The inner surface 197 of the engagement portion 196 of the charging handle 190 engages or otherwise makes contact to a surface 149 facing a recess formed in the carrier body 151 of the carrier assembly 150. The forward facing surface could also be of a raised feature disposed on the carrier body 151. The contact between the inner surface 197 of the engagement portion 196 and the surface 149 on the carrier body 151 provides the ability to manually cycle the BCG 140 by pulling back and releasing the charging handle 190.

In one or more embodiments, an upper receiver assembly for one or more weapon systems is provided and can include the upper receiver 104, the barrel 101, and the gas block 103, as depicted in FIGS. 1, 2, and 5, as well as the gas operating system 100, as described and discussed herein. The gas block 103 is fluidly coupled to the barrel 101 and the gas operating system 100 is fluidly coupled to the gas block 103. The gas operating system 100 can be used on any type of automatic and/or semi-automatic weapon systems, including, but not limited to, AR15, M16, M4, AR10, LR308, SR25, or any derivative thereof. The gas operating system 100 can be used on a weapon system of any size and/or chambered in any caliber or chambering of rifle and/or handgun ammunition.

Assembly: The gas channel carrier rail 120 is installed in the upper receiver of the firearm and attached to the gas block at the front of the barrel. The gas channel carrier rail 120 extends from the gas block on the barrel, through the adjustable tensioner 110 and the upper receiver front wall, to just inside the rear of the upper receiver. The charging handle 190 is installed in the same manner as a standard DGI system (e.g., meets military specifications for the M16 or M4 weapon systems) such that the alignment tabs 193 on each side of the charging handle 190 are aligned with the cut outs in the upper receiver and lowered into place. The slot 194 allows the charging handle 190 to pass over the rear portion of the gas channel carrier rail 120 when installed in the upper receiver.

Once the charging handle 190 is installed, the gas channel carrier guide 180 attached to the bolt carrier is inserted into the rear of the gas channel carrier rail 120; the BCG 140 can then be pushed forward to the closed position. FIG. 7 illustrates a charging handle 190 installed, with the charging handle 190 and the BCG 140 in the "closed" position. As illustrated, the charging handle 190 accommodates the gas channel carrier guide 180, as well as the gas channel carrier rail 120, when in the closed position, while still allowing functioning of the weapon system.

DGI System Operation:

The gas operating system 100, as described and discussed here, is pressurized via a gas block attached to the barrel. The pressurized propellant gas travels rearward through the gas channel carrier rail 120 and into the gas channel carrier guide 180 through the inlet port 188 in the gas channel carrier rail 120 that are in alignment with the main gas channel 122 on the gas channel carrier guide 180, and into the gas chamber 152 formed in the rear of the BCG 140. Once pressurized, the action unlocks and, the expanding propellant gases force the carrier assembly 150 to the rear unlocking the bolt head 171 on the bolt assembly 170 from the barrel extension (not shown) allowing the BCG 140 to move rearward and operate the action of the weapon.

In addition, in contrast to the piston systems described above, the individual parts of the action of the gas operating system 100 are designed to operate with the "balanced in-line" operation of the pressurized gas chamber at the rear of the bolt and carrier. This "balanced in-line" system does not induce any offset or out of alignment forces on the bolt and bolt carrier and allows for a smooth operation of the weapon.

Once the BCG 140 has moved rearward completely to unlock the bolt from the barrel extension, the front gas rings 176 on the carrier assembly 150 have moved forward of the exhaust ports 107 on the right side of the carrier assembly 150, opening the exhaust ports 107 and allowing the propellant gases to be discharged out through the exhaust ports 107. In such a manner, propellant gas is directed through the exhaust port 107 in the gas operating system 100, rather than permitting exhausted propellant gas from escaping through the rear of the bolt carrier and into the action, as occurs with traditional DGI systems. The BCG 140 continues rearward until the operating or buffer spring is fully compressed, the compressed buffer spring then forces the BCG 140 forward and closes the action, with the BCG 140 locking the bolt head 171 into the barrel extension and the weapon is ready to be fired again.

Benefits of the Direct Gas Impingement (DGI), Gas Operating System 100:

The gas operating system 100 maintains the balanced "in-line" pressurized chamber design that utilizes the expanding gases from the fired cartridge to operate the weapon and contains the gases in a "closed" system that minimizes exposure of the operating parts of the weapon to the hot carbon laden gases that overheat and foul the weapon's action.

The closed system of the gas operating system 100 requires less amount (e.g., volume) of propellant gas to operate than the traditional DGI system because the gas operating system 100 is more efficient, therefore allowing the use of a smaller diameter gas port in the barrel from which the gases are obtained. Because the system requires less volume to operate, less heat and carbon fouling is directed into the system with each shot fired, this results in a cleaner and cooler operating system compared to the traditional DGI system.

The gas operating system 100, as described and discussed herein, is a closed design that keeps the gases that are required to operate the action in a "sealed channel" from the time they enter the system at the gas port in the barrel, until they are discharged out through the right side of the bolt carrier, minimizing exposure of the other components of the weapons action to the propellant gases.

Figure 8:
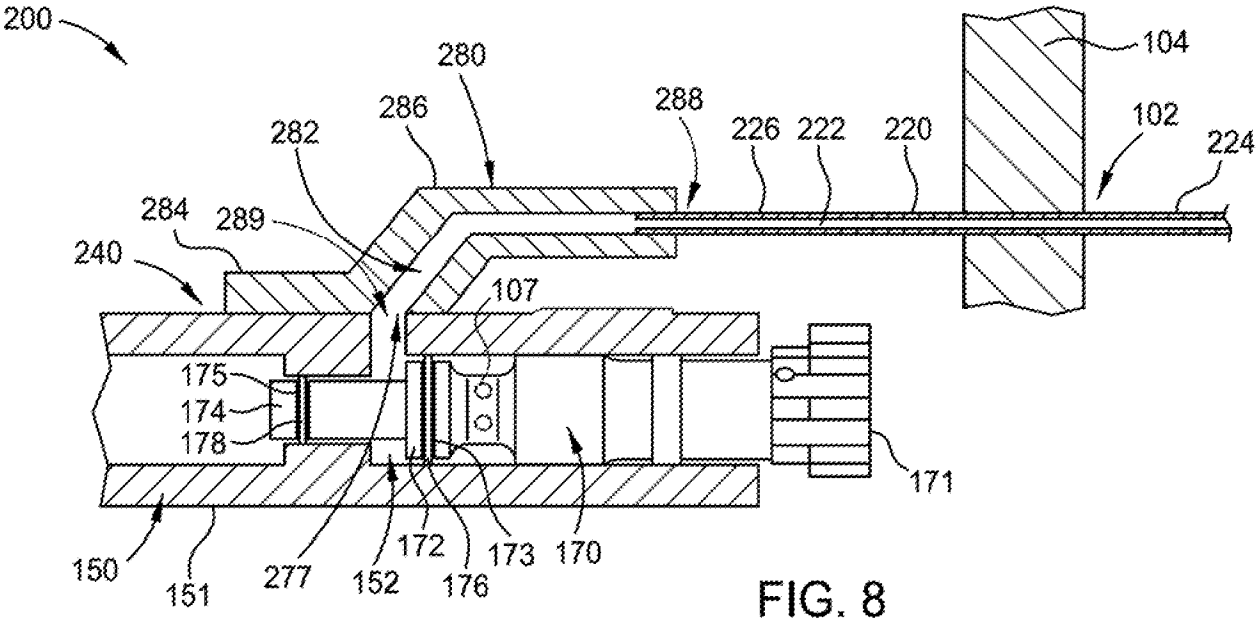
FIG. 8 depicts a partial schematic, cross-sectional view of another gas operating system for weapon systems, according to one or more embodiments described herein.

FIG. 8 depicts a partial schematic, cross-sectional view of a gas operating system 200 for a firearm or other weapon system, according to one or more embodiments described herein. The gas operating system 200 is a direct gas impingement system and includes a gas tube 220 and a bolt carrier group (BCG) 240. The gas tube 220 contains a main gas channel 222 disposed between an inlet end 224 an outlet end 226. The gas tube 220 can be made of or contain one or more metals, such as steel, stainless steel, titanium, or alloys thereof. In one or more examples, the gas tube 220 can be a traditional gas tube for automatic and/or semi-automatic weapon systems, such as AR15, M16, M4, or other weapon systems. For example, the gas tube 220 can be a gas tube of a known length, such as a rifle length, a medium length, a carbine length, a pistol length, or can be any other specified or custom length.

Figure 9:
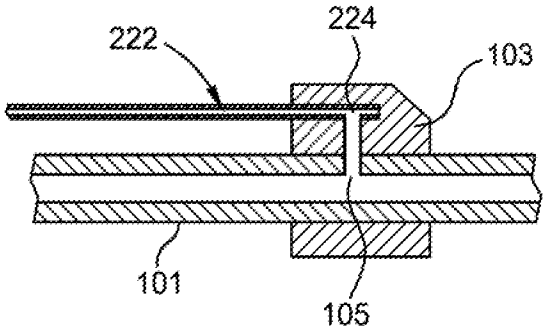
FIG. 9 depicts a schematic, cross-sectional view of another portion of the gas operating system shown in FIG. 8, according to one or more embodiments described herein.

The gas tube 220 extends through an opening 102 passing through a wall of the upper receiver 104 of the firearm, as depicted in FIG. 8. The outlet end 226 of the gas tube 220 extends partially into the gas key 280 and is in fluid communication thereto, as further discussed below. The inlet end 224 of the gas tube 220 is configured to couple to a gas block 103 disposed on a barrel 101 of the weapon system, as depicted in FIG. 9. A passageway 105 is disposed between and in fluid communication of the barrel 101 and the main gas channel 222 at the inlet end 224. In one or more embodiments, the inlet end 224 of the gas tube 220 includes a gas tube portion between the gas block 103 that is straight or significantly straight and parallel or significant parallel to the barrel 101. In other embodiments, the inlet end 224 of the gas tube 220 includes a gas tube portion between the gas block 103 and the adjustable tensioner 110 that has one or more bends or curves.

The gas block 103 can be any gas block that meets or exceeds U.S. military specifications for the M16 or M4 weapon systems or any gas block used in the AR15 weapon system. The gas block 103 attached to the barrel 101 that directs the expanding gases from the gas port 105 in the barrel 101 into the inlet end 224 of the gas tube 220. In some examples, the gas block 103 can be a standard, non-adjustable gas block. In other examples, the gas block 103 can be an adjustable or tunable gas block. The gas tube 220 may attach to the gas block 103 with a pin or screw. The gas block 103 may be any height or profile (e.g., low or high profile gas blocks) to accommodate the gas tube 220 with straight line.

The BCG 240 contains a carrier assembly 150, a bolt assembly 170, and a gas key 280. The bolt assembly 170 is at least partially contained within the carrier assembly 150. The bolt assembly 170 and the carrier assembly 150 are axial to one another. A bolt head 171 of the bolt assembly 170 extends from the carrier assembly 150. The carrier assembly 150 contains a carrier body 151 and a gas key 280. One, two, three, or more exhaust ports 107 (two exhaust ports are drawn in phantom in FIG. 8) extend through the carrier body 151 to fluidly connect the gas chamber 152 to outside of the BCG 240 once the bolt assembly 170 is in the extended position (e.g., during cycling of the firearm) relative to the carrier assembly 150.

The gas key 280 is disposed on the carrier body 151 of the carrier assembly 150. In one or more embodiments, the gas key 280 and the carrier body 151 are monolithic, as such, are formed or otherwise produced as a single unit having a one piece design. In other embodiments, the gas key 280 and the carrier body 151 are separate parts that are fastened or combined together. For example, one, two, three, or more fasteners can be used to couple the gas key 280 and the carrier body 151 together. In one example, the gas key 280 and the carrier body 151 are coupled together with two bolts that pass through the gas key 280 and into threaded holes in the carrier body 151 and are each staked at the gas key 280. In other examples, the gas key 280 and the carrier body 151 are welded together. Each of the gas key 280 and the carrier body 151 can be made of or contain one or more metals, such as steel, stainless steel, titanium, or alloys thereof.

The gas key 280 contains a secondary gas channel 282 passing therethrough. The secondary gas channel 282 is disposed between and in fluid communication with the main gas channel 222 and an interior (e.g., gas chamber 152) of the BCG 240. The gas key 280 contains a lower segment 284 and an upper segment 286. The lower segment 284 is coupled to the carrier assembly 150. The gas key 280 contains an inlet port 288 and an outlet port 289. The inlet port 288 of the gas key 280 is in fluid communication with and coupled to the main gas channel 222 via the outlet end 226 of the gas tube 220. The inlet port 288 of the gas key 280 receives the outlet end 226 of the gas tube 220 which extends partially into the gas key 280. The outlet port 289 of the gas key 280 is in fluid communication with and coupled to an inlet port 277 formed through the carrier body 151 of the BCG 240. The secondary gas channel 282 extends from the inlet port 288 to the outlet port 289 and to the interior of the BCG 240, such as into the gas chamber 152, via the inlet port 277. In one or more embodiments, the gas key 280 can include a gas tube or guide that is hollow or has a passageway in the center with the secondary gas channel 282 that passes from the top center at the inlet port 288, through the neck of the guide, out of the bottom at the outlet port 289, and into the inlet port 277 on the carrier body 151 and into the gas chamber 152. The gas chamber 152 is formed or otherwise disposed within the interior of the BCG 240. The gas chamber 152, as well as other parts, portions, and/or components of the BCG 240 are the same as the similarly numbered parts, portions, and/or components of the BCG 140 and therefore are further discussed above.

In FIG. 8, the bolt assembly 170 is depicted in a contracted or non-extended position relative to the carrier assembly 150. When in a weapon system, the bolt assembly 170 is all the way forward and the bolt head 171 is closed and locked into the barrel extension (not shown). The outlet end 226 of the gas tube 220 is at least partially extended into the inlet port 288 of the gas key 280. The inlet port 288 of the gas key 280 is in fluid communication with and coupled to the main gas channel 222 via the outlet end 226 of the gas tube 220. The inlet port 288 of the gas key 280 receives the outlet end 226 of the gas tube 220 which extends partially into the gas key 280. The outlet port 289 of the gas key 280 is in fluid communication with and coupled to the carrier body 151 of the BCG 240. Although not shown for the BCG 240, after a cartridge has been fired in the weapon, the bolt assembly 170 is moved into a non-extracted or extended position relative to the carrier assembly 150, the same position as shown for the BCG 140 of the gas operating system 100, illustrated in FIG. 5. Once the bolt assembly 170 is moved into the non-extracted or extended position, the propellant gas escapes or otherwise flows through the exhaust ports 107 that are placed in fluid communication to the gas chamber 152.

Figure 10A:
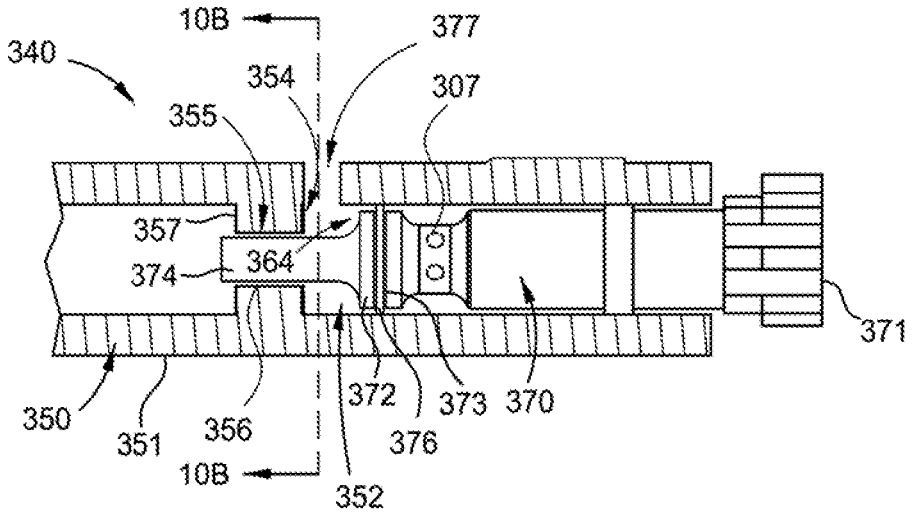
FIG. 10A (PRIOR ART)
FIGS. 10A and 10B depict partial schematic, cross-sectional views of a bolt carrier group, as known in the prior art.
Figure 10B:
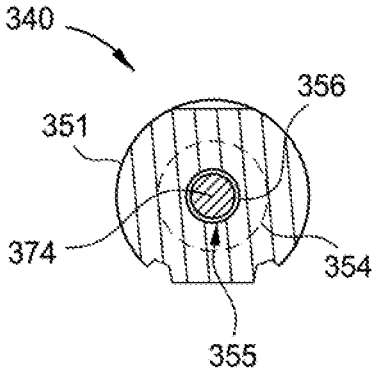
FIG. 10B (PRIOR ART)

FIGS. 10A and 10B depict partial schematic, cross-sectional views of a bolt carrier group (BCG) 340, as known in the prior art. The BCG 340 is a typical bolt carrier group which meets the U.S. military specifications for use in the M16 or M4 weapon systems. The BCG 340 contains a carrier assembly 350 and a bolt assembly 370, as depicted in FIG. 10A. The bolt assembly 370 is at least partially contained within the carrier assembly 350. The bolt assembly 370 and the carrier assembly 350 are axial to one another. A bolt head 371 of the bolt assembly 370 extends from the carrier assembly 350. As depicted in FIG. 10A, the bolt assembly 370 is in a contracted or non-extended position relative to the carrier assembly 350. The carrier assembly 350 is all the way forward relative to the bolt assembly 370. If positioned in the weapon system and in this contracted or non-extended position, the bolt head 371 is closed and locked into the barrel extension of the weapon system (not shown).

The carrier assembly 350 has a carrier body 351 and an inlet port 377 formed within and passes through the carrier body 351. A gas chamber 352 is contained within the carrier body 351. Neither a gas channel carrier guide (e.g., the gas channel carrier guide 180, as illustrated in FIG. 1) nor a gas key (e.g., the gas key 280, as illustrated FIG. 8) are shown in FIG. 10A, but either can be coupled to the carrier body 351 over the inlet port 377. The inlet port 377 provides fluid communication between the gas channel carrier guide or the gas key to the interior of the carrier body 351, such as the gas chamber 352. The inlet port 377 receives the propellant gas from the gas block (as depicted in FIGS. 2 and 9) via the gas channel carrier guide or the gas key and passes the propellant gas into the gas chamber 352.

The gas chamber 352 is formed between the carrier assembly 350, the bolt assembly 370 having a bolt tail 374, and one or more gas seals 376. The gas seal 376 is contained on a journal or gas collar 372 disposed on the bolt assembly 370. The gas collar 372 can include one or more recesses or grooves 373 for containing one or more gas seals 376. The gas seal 376 can be or include 1, 2, 3, 4, or more rings, seals, gaskets, O-rings, or other devices used for gas sealing between two or more surfaces. In some examples, the gas seals 376 can be 1, 2, or 3 metallic gas rings that meet or exceed U.S. military specifications for the M16 or M4 weapon systems. In one or more examples, the gas seal 376 contains three metallic gas rings.

The carrier body 351 includes a shoulder 357 disposed within the carrier body 351. The shoulder 357 can support or help align the bolt tail 374 of the bolt assembly 370. An inner surface 356 of the shoulder 357 defines an opening 355 in which the bolt tail 374 disposed therein. The diameter of the bolt tail 374 is smaller than the opening 355, therefore the remaining portion of the opening 355 forms a gap or space disposed between the bolt tail 374 and the inner surface 356. This gap or space within the opening 355 is part of the gas chamber 352 and provides an exhaust port for propellant gas, received from the inlet port 377, to pass through and exit into the rear of the bolt carrier 340 and into the action of the weapon, as occurs with traditional DGI systems. In one or more examples, such as for AR15, M16, M4, AR10, LR308, SR25, and other weapon systems, the opening 355 is about 0.2535 inches to about 0.2540 inches in diameter and the diameter of the bolt tail 374 is about 0.250 inches.

The gas chamber 352 also has a pressure surface 354 disposed on an inner surface of the carrier body 351 opposite from the journal or gas collar 372 on the bolt assembly 370. The pressure surface 354, as illustrated in FIGS. 10A and 10B, surrounds the opening 355 and the bolt tail 374 (when disposed between the inner surface 356) and is the back inner surface of the carrier body 351. The propellant gas fills and pressurizes the gas chamber 352 which results in the pressure surface 354 and all of the other surfaces within the gas chamber 352 to endure the pressure.

Because the gas chamber 352 uses pressurized propellant gas from the fired cartridge to pressurize the gas chamber 352 and cycle the weapon, the BCG 340 operates in a pneumatic fashion. As such, the force and speed with which the bolt carrier 350 is pushed to the rear (away from the bolt assembly 370) is directly related to the difference between the pressure surface 354 in the rear the gas chamber 352 and the pressure surface 364 in front of the gas chamber 352 (e.g., the gas collar 372 and the gas seal 376).

The bolt tail 374 extends most of the length of the gas chamber and passes through the opening or space 355 in the rear of the carrier body 351 resulting in both ends of the gas chamber 352 having the same surface area or substantially the same surface area. This configuration in which both sides (e.g., the pressure surfaces 354 and 364) of the gas chamber 352 having the same surface area or substantially the same surface area is the standard in the industry, regardless of the size of the weapon or the carrier and bolt assemblies. Although the pressure surface 354 is different between various sizes of the weapon or the carrier and bolt assemblies and the pressure surface 364 is different between various sizes of the weapon or the carrier and bolt assemblies, within any particular size of weapon, the pressure surfaces 354 and 364 are the same surface area or substantially the same.

For example, such as for an AR15, M16, and/or M4 type weapon systems, the diameter of the bolt tail 374 is about 0.250 inches and the pressure surfaces 354 and 364 are about 0.147 square inches, as depicted in FIG. 10B. The gap or space between the bolt tail 374 and the outer surface of the opening 355 is about $1.25\times10^{-5}$ square inches for an AR15, M16, and/or M4 type weapon systems, which is a very small value relative to the pressure surfaces 354 and 364 having an area of about 0.147 square inches. As such, the pressure surfaces 354 and 364 have the same surface area or substantially the same surface area as each other. Therefore, the carrier body 351 moves backwards away from the bolt assembly 370 at a standardized rate relative to the amount of pressure applied by the propellant gas.

In other examples, such as for an AR10, LR308, and/or SR25 type weapon systems, the diameter of the bolt tail is about 0.250 inches and the pressure surfaces 354 and 364 are about 0.293 square inches, which is twice the surface area as in the AR15, M16, and/or M4 type weapon systems. The gap or space between the bolt tail 374 and the outer surface of the opening 355 is about $1.25\times10^{-5}$ square inches for an AR10, LR308, and/or SR25 type weapon systems, which is a very small value relative to the pressure surfaces 354 and 364 having an area of about 0.293 square inches. As such, regardless of the larger size of the AR10, LR308, and/or SR25 type weapon systems, the pressure surfaces 354 and 364 have the same surface area or substantially the same surface area as each other. Therefore, the carrier body 351 moves backwards away from the bolt assembly 370 at a standardized rate relative to the amount of pressure applied by the propellant gas, although the standardized rate may be the same or different in various weapons systems.

Also, one, two, three, or more exhaust ports 307 (two exhaust ports are drawn in phantom in FIG. 10A) extend through the carrier body 351 to fluidly connect the gas chamber 352 to outside of the BCG 340 once the bolt assembly 370 is in the extended position (e.g., during cycling of the firearm) relative to the carrier assembly 350. The exhaust ports 307 are configured and work the same as described and discussed above for the exhaust ports 107.

Figure 11A:
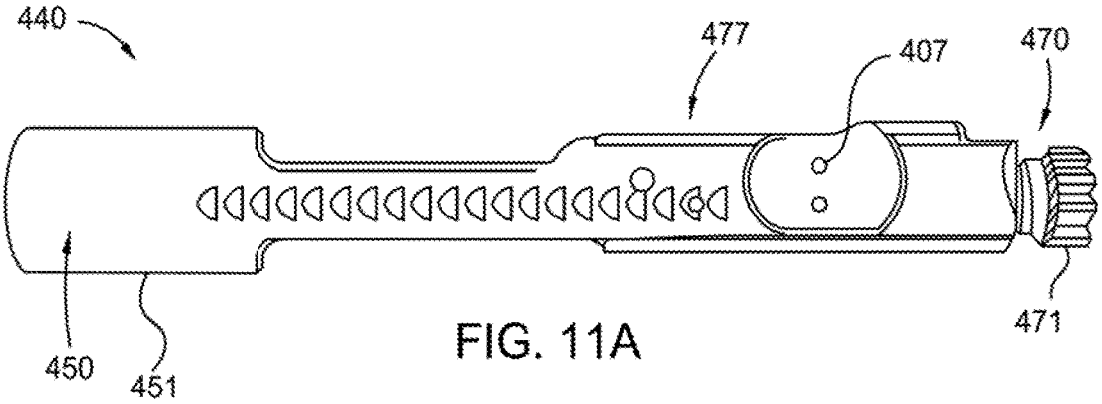
FIG. 11A depicts a partial schematic view of a bolt carrier group that is utilized in gas operating systems for weapon systems, according to one or more embodiments described herein.
Figure 11B:
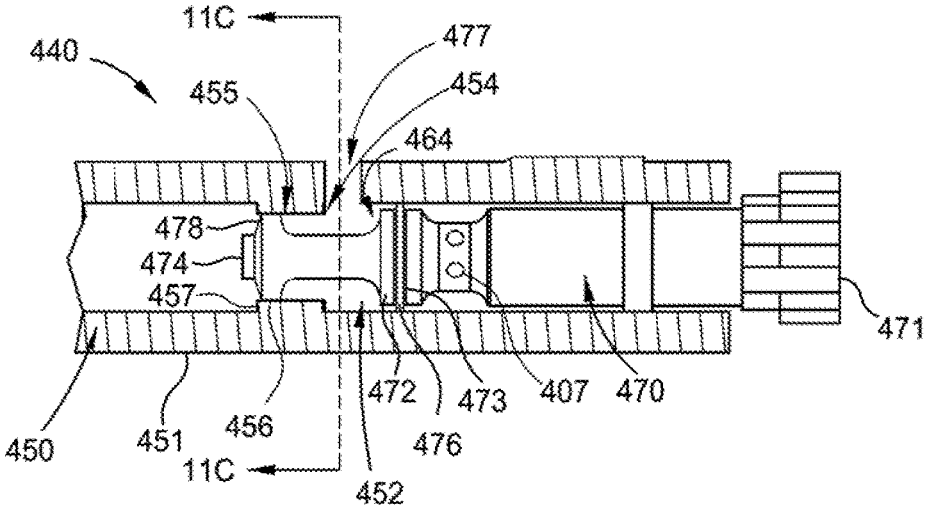
FIGS. 11B and 11C depict partial schematic, cross-sectional views of the bolt carrier group illustrated in FIG. 11A, according to one or more embodiments described herein.
Figure 11C:
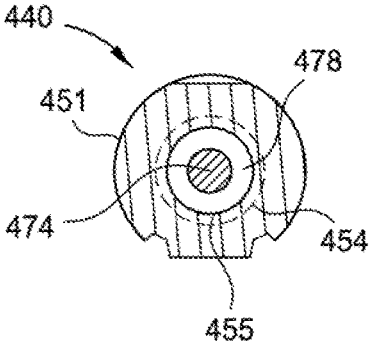

FIG. 11A depicts a partial schematic view of a bolt carrier group (BCG) 440 that is utilized in gas operating systems for weapon systems, according to one or more embodiments described herein. FIGS. 11B and 11C depict partial schematic, cross-sectional views of the BCG 440. The BCG 440 contains a carrier assembly 450 and a bolt assembly 470, as depicted in FIGS. 11A and 11B. The bolt assembly 470 is at least partially contained within the carrier assembly 450. The bolt assembly 470 and the carrier assembly 450 are axial to one another. A bolt head 471 of the bolt assembly 470 extends from the carrier assembly 450. As depicted in FIG. 11B, the bolt assembly 470 is in a contracted or non-extended position relative to the carrier assembly 450. The carrier assembly 450 is all the way forward relative to the bolt assembly 470. If positioned in the weapon system and in the contracted position, the bolt head 471 is closed and locked into the barrel extension of the weapon system (not shown).

When the bolt assembly 470 is in a contracted position relative to the carrier assembly 450, fluid communication between the gas chamber 452 and the exhaust port 407 is closed for removal of the propellant gas from the gas chamber 452. That is, the gas seal 476 maintains no fluid communication between the gas chamber 452 and the exhaust ports 407 so that the propellant gas builds pressure within the gas chamber 452 until the carrier assembly 450 moves into the extended position. Therefore, the bolt assembly 470 is in an extended position relative to the carrier assembly 450 (which moves away from the bolt assembly 450) when fluid communication between the gas chamber 452 and the exhaust ports 407 is opened or established for removal of the propellant gas from the gas chamber 452.

Also, one, two, three, or more exhaust ports 407 (two exhaust ports are drawn in phantom in FIG. 11B) extend through the carrier body 451 to fluidly connect the gas chamber 452 to outside of the BCG 440 once the bolt assembly 470 is in the extended position (e.g., during cycling of the firearm) relative to the carrier assembly 450. The exhaust ports 407 are configured and work the same as described and discussed above for the exhaust ports 107.

The carrier assembly 450 has a carrier body 451 and an inlet port 477 formed within and passes through the carrier body 451. A gas chamber 452 is contained within the carrier body 451. Neither a gas channel carrier guide (e.g., the gas channel carrier guide 180, as illustrated in FIG. 1) nor a gas key (e.g., the gas key 280, as illustrated FIG. 8) are shown in FIG. 11B, but either can be coupled to the carrier body 451 over the inlet port 477. The inlet port 477 provides fluid communication between the gas channel carrier guide or the gas key to the interior of the carrier body 451, such as the gas chamber 452. The inlet port 477 receives the propellant gas from the gas block (as depicted in FIGS. 2 and 9) via the gas channel carrier guide or the gas key and passes the propellant gas into the gas chamber 452. As such, a gas channel carrier guide (e.g., the gas channel carrier guide 180, as illustrated in FIG. 1) or a gas key (e.g., the gas key 280, as illustrated FIG. 8) is in fluid communication with the inlet port 477 on the carrier body 451, as well as the gas chamber 452.

The gas chamber 452 is formed between the carrier assembly 450, the bolt assembly 470 having a bolt tail 474, and two or more gas seals 476, 478. The gas seals 476, 478 extend independently from the bolt tail 474. In one configuration, as depicted in FIG. 11B, the gas seal 476 is a forward gas seal, the gas seal 478 is a rear gas seal, the gas seal 476 is disposed between the gas seal 478 and the bolt head 471. In one embodiment, the gas seal 476 is contained on a journal or gas collar 472 disposed on the bolt assembly 470. The gas collar 472 can include one or more recesses or grooves 473 for containing one or more gas seals 476. Although not shown, the gas seal 478 can be configured the same as the gas seal 476. For example, the gas seal 478 can also be contained on a journal or gas collar disposed on the bolt tail 474 where the journal or gas collar can include one or more recesses or grooves for containing one or more gas seals 478. In some embodiments, each of the forward gas seal 476 and the rear gas seal 478 can independently be or contain 1, 2, 3, 4, or more rings, seals, gaskets, O-rings, journals, collars, protrusions, or other devices used for gas sealing between two or more surfaces, or any combination thereof. In some examples, the gas seal 476 can be 1, 2, or 3 metallic gas rings that meet or exceed U.S. military specifications for the M16 or M4 weapon systems. In one or more examples, the gas seal 476 contains one or more metallic gas rings and the gas seal 478 contains one or more journals, collars, protrusions, O-rings, or any combination thereof. In some examples, each of the gas seals 476, 478 independently contains three metallic gas rings.

The carrier body 451 includes a shoulder 457 disposed within the carrier body 451. The shoulder 457 can support or help align the bolt tail 474 of the bolt assembly 470. An inner surface 456 of the shoulder 457 defines an opening or channel 455, such as a boat tail channel, in which the bolt tail 474 and the gas seal 478 are disposed within. The diameter of the gas seal 478 is the same or less than as the channel 455. In one embodiment, as shown in FIG. 11B, the diameter of the gas seal 478 is the same or substantially the same as the diameter of the channel 455 and therefore forms an interface between the inner surface 456 of the shoulder 457 and the gas seal 478. In another embodiment, not shown, the diameter of the gas seal 478 is less than the diameter of the channel 455 and therefore the remaining portion of the channel 455 forms a gap or space disposed between the inner surface 456 of the shoulder 457 and the gas seal 478. This gap or space within the channel 455 is part of the gas chamber 452 and provides an exhaust port for propellant gas, received from the inlet port 477, to pass through and exit into the rear of the bolt carrier 440 and into the action of the weapon, as occurs with traditional DGI systems.

The gas chamber 452 also has a piston surface 454 disposed on an inner surface of the carrier body 451 opposite from the journal or gas collar 472 on the bolt assembly 470. The piston surface 454, as illustrated in FIGS. 11B and 11C, surrounds the channel 455 and the gas seal 478 and the bolt tail 474 (when disposed between the inner surface 456) and is the back inner surface of the carrier body 451. The propellant gas fills and pressurizes the gas chamber 452 which results in the piston surface 454 and all of the other surfaces within the gas chamber 452 to endure the pressure.

The gas chamber 452 uses pressurized propellant gas from the fired cartridge to pressurize the gas chamber 452 and cycle the weapon, therefore, the BCG 440 operates in a pneumatic fashion. As such, the force and speed with which the bolt carrier 450 is moved to the rear away from the bolt assembly 470 is directly related to the area difference between the piston surface 454 in the rear of the gas chamber 452 and the pressure surface 464 in front of the gas chamber 452 (e.g., the gas collar 472 and the gas seal 476). The BCG 440 has better control of the cycle speed in a DGI system so to have more consistent cycling than a traditional BCG used in weapon systems having DGI.

The opening or space 455 in the rear of the carrier body 451 has a larger diameter compared to the corresponding opening in a traditional or military specification carrier body. The combination of the bolt tail 474 and the gas seal 478 has a larger diameter compared to the corresponding bolt tail on a traditional or military specification bolt assembly. However, the piston surface area, which is the area of the piston surface 454 in the rear portion of the gas chamber 452, is less than the forward chamber surface area, which is the area of the pressure surface 464 in forward portion of the gas chamber 452.

Since the area of the piston surface 454 in the rear of the gas chamber 452 (e.g., the piston surface area) is less than the area of the pressure surface 464 in front of the gas chamber 452 (e.g., the forward chamber surface area), the carrier body 451 moves backwards away from the bolt assembly 470 at a slower rate proportional to the area differential between the piston surface 454 and the pressure surface 464. The surface area of the pressure surface 464 is about 0.147 square inches for an AR15, M16, and M4 weapon systems. This configuration in which the surface area of the piston surface 454 in the rear of the gas chamber 452 is less than the surface area of the pressure surface 464 in front of the gas chamber 452 can be scaled regardless of the size of the weapon or the carrier and bolt assemblies.

For the BCG 440, the area of the piston surface 454, such as the piston surface area, is less than the area of the pressure surface 464, such as the forward chamber surface area. Particular percentages of the piston surface area relative to the forward chamber surface area can be adjusted to better control the cycle speed and have more consistent cycling. Smaller value percentages are proportionally related to slower cycle speeds. Regardless of the type of weapon system, the area of the piston surface 454, such as the piston surface area, is about 99%, about 98%, about 97%, about 96%, about 95%, about 90%, about 85%, or less of the area of the pressure surface 464, such as the forward chamber surface area. In some examples, the piston surface area is about 10%, about 20%, about 25%, about 30%, about 35%, about 40%, about 45%, about 48%, or about 50% to about 55%, about 60%, about 65%, about 68%, about 70%, about 75%, about 80%, about 85%, about 90%, about 95%, about 97%, about 98%, or about 99% of the forward chamber surface area. For example, the piston surface area is about 20% to about 99%, about 20% to about 98%, about 20% to about 97%, about 20% to about 95%, about 25% to about 97%, about 25% to about 95%, about 25% to about 90%, about 25% to about 85%, about 25% to about 80%, about 25% to about 70%, about 25% to about 60%, about 25% to about 50%, about 40% to about 85%, about 40% to about 75%, about 40% to about 65%, about 40% to about 55%, about 48% to about 85%, about 50% to about 85%, or about 60% to about 85% of the forward chamber surface area.

In one or more embodiments, such as for AR15, M16, M4, AR10, LR308, SR25, and other weapon systems, the diameter of the gas seal 478 on the bolt tail 474 is greater than 0.250 inches, such as from about 0.260 inches, about 0.270 inches, about 0.280 inches, or about 0.300 inches to about 0.320 inches, about 0.350 inches, about 0.370 inches, about 0.400 inches, about 0.420 inches, about 0.440 inches, or greater. In some examples, the diameter of the gas seal 478 on the bolt tail 474 is greater than 0.250 inches to about 0.440 inches, greater than 0.250 inches to about 0.420 inches, greater than 0.250 inches to about 0.400 inches, greater than 0.250 inches to about 0.380 inches, greater than 0.250 inches to about 0.360 inches, greater than 0.250 inches to about 0.340 inches, about 0.260 inches to about 0.440 inches, about 0.260 inches to about 0.420 inches, about 0.260 inches to about 0.400 inches, about 0.260 inches to about 0.380 inches, about 0.260 inches to about 0.360 inches, about 0.260 inches to about 0.340 inches, about 0.300 inches to about 0.440 inches, about 0.300 inches to about 0.420 inches, about 0.300 inches to about 0.400 inches, about 0.300 inches to about 0.380 inches, about 0.300 inches to about 0.360 inches, about 0.300 inches to about 0.340 inches, about 0.35 inches to about 0.44 inches, about 0.35 inches to about 0.42 inches, about 0.35 inches to about 0.40 inches, about 0.35 inches to about 0.38 inches, about 0.33 inches to about 0.37 inches, about 0.34 inches to about 0.36 inches, about 0.38 inches to about 0.42 inches, or about 0.39 inches to about 0.41 inches.

In some embodiments, the piston surface 454, as depicted in FIG. 11C, for AR15, M16, M4, and other weapon systems, has an area (e.g., the piston surface area) of less than 0.147 square inches, less than 0.145 square inches, or less than 0.140 square inches. In some examples, the piston surface 454 has an area of about 0.05 square inches, about 0.06 square inches, about 0.07 square inches, or about 0.08 square inches to about 0.09 square inches, about 0.10 square inches, about 0.11 square inches, about 0.12 square inches, about 0.13 square inches, or about 0.135 square inches. For example, the piston surface 454 can have an area of about 0.05 square inches to less than 0.135 square inches, about 0.05 square inches to less than 0.13 square inches, about 0.05 square inches to less than 0.125 square inches, about 0.05 square inches to less than 0.12 square inches, about 0.05 square inches to less than 0.11 square inches, about 0.05 square inches to less than 0.10 square inches, about 0.05 square inches to less than 0.09 square inches, about 0.05 square inches to less than 0.08 square inches, about 0.05 square inches to less than 0.07 square inches, about 0.07 square inches to less than 0.135 square inches, about 0.07 square inches to less than 0.13 square inches, about 0.07 square inches to less than 0.125 square inches, about 0.07 square inches to less than 0.12 square inches, about 0.07 square inches to less than 0.11 square inches, about 0.07 square inches to less than 0.10 square inches, about 0.07 square inches to less than 0.09 square inches, or about 0.07 square inches to less than 0.08 square inches.

In other embodiments, the piston surface 454, as depicted in FIG. 11C, for AR10, LR308, SR25, and other weapon systems, has an area (e.g., the piston surface area) of less than 0.293 square inches, less than 0.292 square inches, less than 0.290 square inches, or less than 0.288 square inches. In some examples, the piston surface 454 has an area of about 0.05 square inches, about 0.06 square inches, about 0.07 square inches, about 0.08 square inches, about 0.10 square inches, or about 0.12 square inches to about 0.14 square inches, about 0.16 square inches, about 0.18 square inches, about 0.20 square inches, about 0.22 square inches, about 0.25 square inches, about 0.27 square inches, about 0.275 square inches, about 0.28 square inches, about 0.285 square inches, about 0.29 square inches, about 0.291 square inches, or about 0.292 square inches. For example, the piston surface 454 can have an area of about 0.05 square inches to about 0.29 square inches, about 0.08 square inches to about 0.29 square inches, about 0.10 square inches to about 0.29 square inches, about 0.12 square inches to about 0.29 square inches, about 0.15 square inches to about 0.29 square inches, about 0.18 square inches to about 0.29 square inches, about 0.2 square inches to about 0.29 square inches, about 0.22 square inches to about 0.29 square inches, about 0.25 square inches to about 0.29 square inches, about 0.27 square inches to about 0.29 square inches, about 0.05 square inches to about 0.27 square inches, about 0.08 square inches to about 0.27 square inches, about 0.1 square inches to about 0.27 square inches, about 0.12 square inches to about 0.27 square inches, about 0.15 square inches to about 0.27 square inches, about 0.18 square inches to about 0.27 square inches, about 0.2 square inches to about 0.27 square inches, about 0.22 square inches to about 0.27 square inches, about 0.25 square inches to about 0.27 square inches, about 0.05 square inches to about 0.25 square inches, about 0.08 square inches to about 0.25 square inches, about 0.1 square inches to about 0.25 square inches, about 0.12 square inches to about 0.25 square inches, about 0.15 square inches to about 0.25 square inches, about 0.18 square inches to about 0.25 square inches, about 0.2 square inches to about 0.25 square inches, or about 0.22 square inches to about 0.25 square inches. In one or more examples, the piston surface has an area of greater than 0.05 square inches to less than 0.293 square inches, greater than 0.15 square inches to less than 0.293 square inches, greater than 0.2 square inches to less than 0.293 square inches, greater than 0.05 square inches to less than 0.29 square inches, greater than 0.15 square inches to less than 0.29 square inches, greater than 0.2 square inches to less than 0.29 square inches, greater than 0.05 square inches to about 0.29 square inches, greater than 0.15 square inches to about 0.29 square inches, greater than 0.2 square inches to about 0.29 square inches, greater than 0.05 square inches to about 0.28 square inches, greater than 0.15 square inches to about 0.28 square inches, or greater than 0.2 square inches to about 0.28 square inches.

Although not shown in the FIGS. 11A-11C or described in the written description, the BCG 440 includes all other parts and components contained in a bolt carrier group that meets or exceeds U.S. military specifications for the M16 or M4 weapon systems. For example, exemplary parts or components used on or in the BCG 440 can be or include, but is not limited to, a firing pin, a firing pin retaining pin, a cam pin, an extractor, an ejector, all pins and springs used with the extractor and the ejector, and/or any combination thereof.

While the foregoing is directed to implementations of the disclosure, other and further implementations may be devised without departing from the basic scope thereof, and the scope thereof is determined by the claims that follow. All documents described herein are incorporated by reference herein, including any priority documents and/or testing procedures to the extent they are not inconsistent with this text. As is apparent from the foregoing general description and the specific embodiments, while forms of the present disclosure have been illustrated and described, various modifications can be made without departing from the spirit and scope of the present disclosure. Accordingly, it is not intended that the present disclosure be limited thereby. Likewise, the term "comprising" is considered synonymous with the term "including" for purposes of United States law. Likewise whenever a composition, an element or a group of elements is preceded with the transitional phrase "comprising", it is understood that we also contemplate the same composition or group of elements with transitional phrases "consisting essentially of," "consisting of", "selected from the group of consisting of," or "is" preceding the recitation of the composition, element, or elements and vice versa.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below.

What is claimed is:

1. A bolt carrier group for a weapon system, comprising:

a carrier assembly comprising a carrier body, the carrier body comprising:

a shoulder disposed within the carrier body and containing a channel therethrough;

a piston surface located on the shoulder at least partially encompassing the channel in the shoulder;

an inlet port extending through the carrier body and configured for receiving propellant gas into the carrier body; and an exhaust port extending through the carrier body and configured for removing the propellant gas from the carrier body;

a bolt assembly at least partially contained within the carrier assembly, the bolt assembly comprising a bolt head opposite of a bolt tail, a bolt body disposed between the bolt head and the bolt tail, the diameter of the bolt tail is smaller than the diameter of the bolt body, the bolt tail is axially aligned with the bolt body, and the bolt tail at least partially protruding into the channel in the shoulder, and wherein a forward gas seal is contained on a gas collar disposed on the bolt body and a rear gas seal is contained on the bolt tail; and a gas chamber disposed between the carrier body, the piston surface, the bolt tail, the forward gas seal, and the rear gas seal.

2. The bolt carrier group of claim 1, wherein each of the forward gas seal and the rear gas seal independently comprises a journal, a collar, a protrusion, an O-ring, or any combination thereof.

3. The bolt carrier group of claim 1, wherein the forward gas seal comprises a forward chamber surface area, and a piston surface area of the piston surface is less than the forward chamber surface area.

4. The bolt carrier group of claim 3, wherein the piston surface area is about 98% or less than the forward chamber surface area.

5. The bolt carrier group of claim 3, wherein the piston surface area is about 25% to about 95% of the forward chamber surface area.

6. The bolt carrier group of claim 3, wherein the piston surface area is about 40% to about 85% of the forward chamber surface area.

7. The bolt carrier group of claim 1, wherein the piston surface has an area of less than 0.14 square inches.

8. The bolt carrier group of claim 1, wherein the piston surface has an area of about 0.05 square inches to less than 0.13 square inches.

9. The bolt carrier group of claim 1, wherein the piston surface has an area of greater than 0.15 square inches to less than 0.29 square inches.

10. The bolt carrier group of claim 1, wherein the carrier assembly further comprises a gas channel carrier guide or a gas key, the gas channel carrier guide or the gas key is in fluid communication with the inlet port on the carrier body.

11. The bolt carrier group of claim 1, wherein the bolt assembly is configured to be in a contracted position relative to the carrier assembly when fluid communication between the gas chamber and the exhaust port is closed for removal of the propellant gas from the gas chamber.

12. The bolt carrier group of claim 1, wherein the bolt assembly is configured to be in an extended position relative to the carrier assembly when fluid communication between the gas chamber and the exhaust port is opened for removal of the propellant gas from the gas chamber.

13. An AR15, M16, or M4 weapon system comprising the bolt carrier group of claim 1.

14. A bolt carrier group for a weapon system, comprising:

a carrier assembly comprising a carrier body, the carrier body comprising:

a shoulder disposed within the carrier body and containing a channel therethrough;

a piston surface located on the shoulder at least partially encompassing the channel in the shoulder; and an inlet port extending through the carrier body and configured for receiving propellant gases into the carrier body;

a bolt assembly at least partially contained within the carrier assembly, the bolt assembly comprising a bolt head opposite of a bolt tail, a bolt body disposed between the bolt head and the bolt tail, the diameter of the bolt tail is smaller than the diameter of the bolt body, the bolt tail is axially aligned with the bolt body, and the bolt tail at least partially protruding into the channel in the shoulder; and a gas chamber disposed between the carrier body, the piston surface, the bolt tail, and two gas seals disposed on the bolt assembly, wherein:

the two gas seals comprise a forward gas seal and a rear gas seal, the forward gas seal is contained on a gas collar disposed on the bolt body, the forward gas seal comprises a forward chamber surface area, the rear gas seal is contained on the bolt tail, and the piston surface area is about 98% or less of the forward chamber surface area.

15. The bolt carrier group of claim 14, wherein the piston surface area is about 25% to about 95% of the forward chamber surface area.

16. The bolt carrier group of claim 14, wherein the piston surface has an area of less than 0.14 square inches.

17. The bolt carrier group of claim 14, wherein the piston surface has an area of about 0.05 square inches to less than 0.13 square inches.

18. The bolt carrier group of claim 14, wherein the piston surface has an area of greater than 0.15 square inches to less than 0.29 square inches.

19. An upper receiver assembly for a weapon system, comprising:

an upper receiver comprising a barrel;

a gas block fluidly coupled to the barrel; and a bolt carrier group fluidly coupled to the gas block, wherein the bolt carrier group comprises:

a carrier assembly comprising a carrier body, the carrier body comprising:

a shoulder disposed within the carrier body and containing a channel therethrough;

a piston surface located on the shoulder at least partially encompassing the channel in the shoulder;

an inlet port extending through the carrier body and configured for receiving propellant gases into the carrier body; and an exhaust port extending through the carrier body and configured for removing the propellant gases from the carrier body;

a bolt assembly at least partially contained within the carrier assembly, the bolt assembly comprising a bolt head opposite of a bolt tail, a bolt body disposed between the bolt head and the bolt tail, the diameter of the bolt tail is smaller than the diameter of the bolt body, the bolt tail is axially aligned with the bolt body, and the bolt tail at least partially protruding into the channel in the shoulder, and wherein a forward gas seal is contained on a gas collar disposed on the bolt body and a rear gas seal is contained on the bolt tail; and a gas chamber disposed between the carrier body, the piston surface, the bolt tail, the forward gas seal, and the rear gas seal.

20. An AR15, M16, or M4 weapon system comprising the bolt carrier group of claim 14.

* * * * *